United States Patent [19]

Schlau et al.

[11] 4,070,967

[45] Jan. 31, 1978

[54] STAMP DESIGN KIT

[75] Inventors: Floyd E. Schlau, Lake Forest; Howard J. Morrison, Deerfield; Albert G. Keller, Chicago, all of Ill.

[73] Assignee: Marvin Glass & Associates, Chicago, Ill.

[21] Appl. No.: 650,895

[22] Filed: Jan. 21, 1976

[51] Int. Cl.[2] ..... B41F 1/04

[52] U.S. Cl. ..... 101/301; 101/333; 35/26

[58] Field of Search ..... 101/327, 333, 368, 371, 101/316, 292, 65, 310, 301, 298, 297; 33/189; 35/26–28, 34

[56] References Cited

U.S. PATENT DOCUMENTS

| | | | |
|---|---|---|---|
| 1,001,151 | 8/1911 | Kellum | 101/298 |
| 1,699,505 | 1/1929 | Nissen | 101/301 |

*Primary Examiner*—Ernest T. Wright, Jr.
*Assistant Examiner*—A. Heinz
*Attorney, Agent, or Firm*—Mason, Kolehmainen, Rathburn & Wyss

[57] ABSTRACT

An arts and crafts type stamp kit including a frame having two generally elongated, diverging, horizontal leg portions for universally mounting an elevated stamp support arm generally at the juncture of the leg portions. An ink stamp is adjustably mounted by a stamp carrier on the free end of the stamp support arm for movement therewith and for longitudinal and rotational movement relative thereto. An ink pad is mounted on one of the legs, and a stamping surface is provided on the other of the legs so that ink may be transferred by the ink stamp from the ink pad to a suitable transferring surface, such as a sheet of paper, positioned on the stamping surface by movement of the support arm to first pick up a film of ink and transfer it to the sheet of paper. The stamp kit includes a rotatable pad on the end of the leg adjacent the stamping surface so that a sheet of paper may be pivotally secured thereto by a suitable adhesive. The paper may be selectively rotated so that repetitive stamping by the user can produce a circularly arranged series of images from the stamp.

14 Claims, 10 Drawing Figures

Fig 1
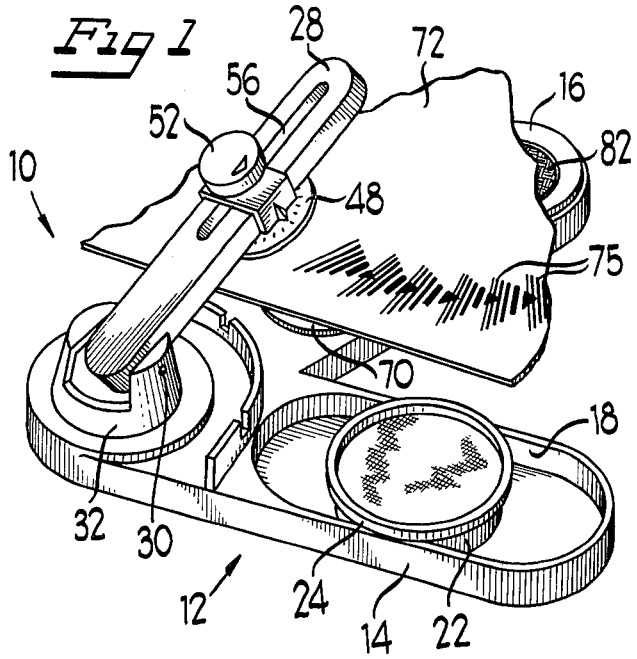
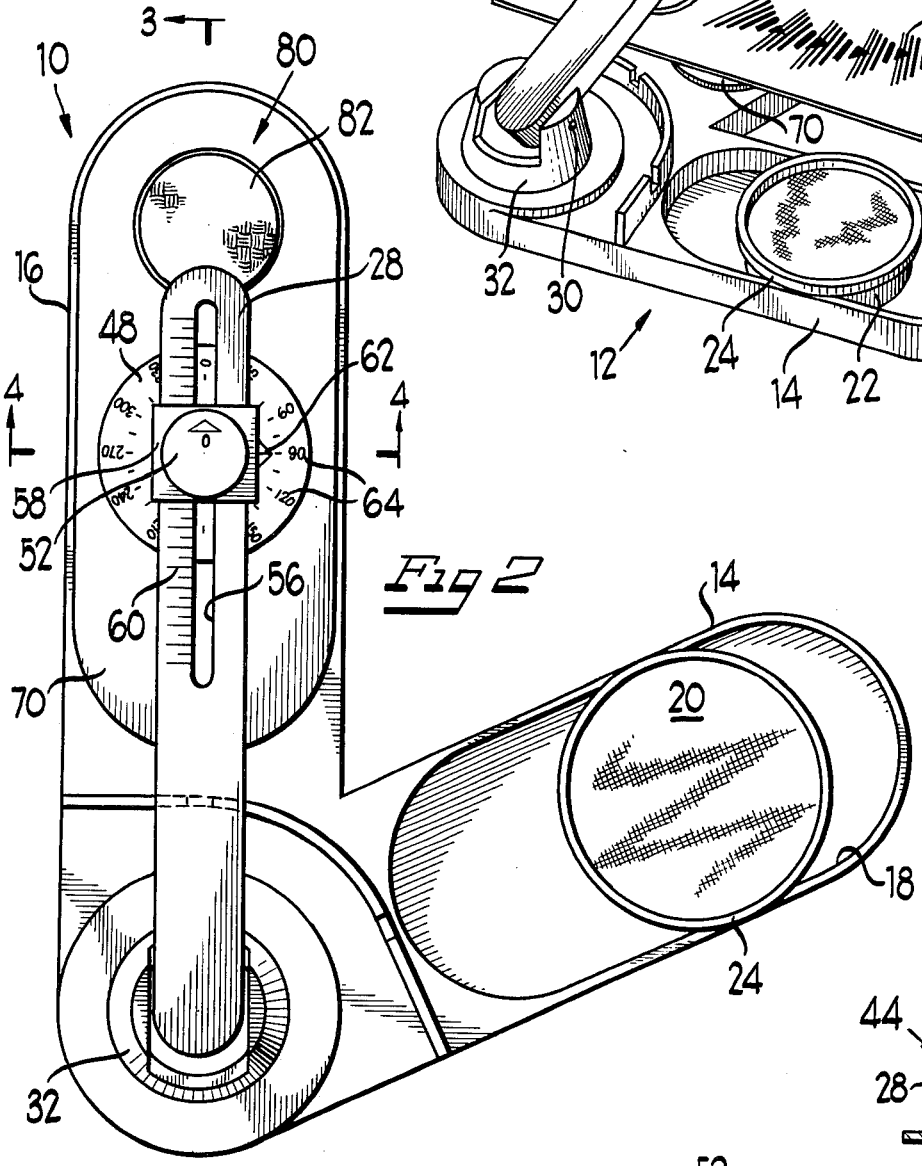
Fig 2
Fig 5
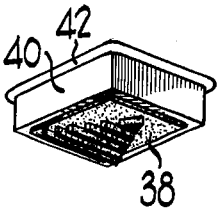
Fig 4
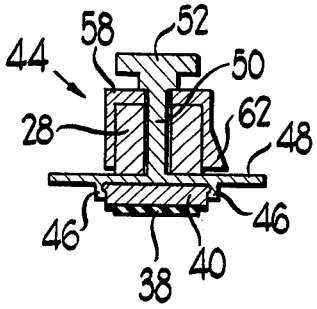
Fig 3
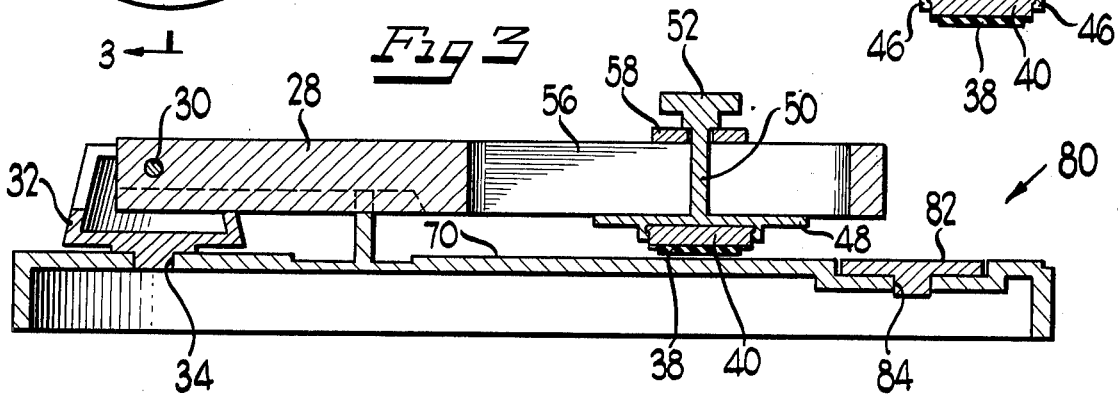

STAMP DESIGN KIT

BACKGROUND OF THE INVENTION

1. Field of the Invention

This invention relates to arts and crafts and in particular to a stamping kit which permits repetitive or sequential stamp designs.

2. Description of the Prior Art

Devices which enable generally unskilled and amateur artists, such as children, to participate in various arts and crafts have been well received by the public. Many of such devices are simply machines which mechanically reproduce a design or the like which is pleasing to the eye while the device itself is very simple to operate. Other types of craft kits require a great degree of skill in order to operate to produce a finished product and therefore many persons have been discouraged from attempting to utilize these types of devices.

SUMMARY OF THE INVENTION

The present invention is directed to a stamp kit which enables a relatively unskilled user to produce a very acceptable final product. The stamp kit includes a frame having a pair of diverging horizontal leg portions and a universally mounted, elevated stamp support arm connected generally at the juncture of the two leg portions. A stamp is adjustably mounted for longitudinal and rotational movement on the free end of the stamp support arm for movement between a stamp pad provided on one leg of the frame to a stamping supporting surface provided on the other leg of the frame. The stamp will pick up ink from the ink pad upon contact therewith and transfer it to a sheet of paper provided on the supporting surface. Means for pivotally mounting a sheet of paper is provided and includes a rotatable pad at the extreme end of one leg adjacent the stamping surface. A suitable adhesive is supplied to the pad so that the sheet of paper can be rotated about a vertical rotational axis spaced from the supporting surface. A successive series of stamp images may be constructed by relative movement of the sheet of paper between each stamping operation.

BRIEF DESCRIPTION OF THE DRAWINGS

FIG. 1 is a perspective view of the stamp design kit of the present invention illustrating one type of design on a fragmented transfer sheet;

FIG. 2 is a top plan view, on an enlarged scale, of the stamp design kit of the present invention;

FIG. 3 is a vertical section of the stamp design kit, taken generally along the line 3—3 of FIG. 2;

FIG. 4 is another vertical section taken generally along line 4—4 of FIG. 2;

FIG. 5 is a perspective view, on an enlarged scale, of one of the stamps provided for use with the stamp design kit;

DESCRIPTION OF THE PREFERRED EMBODIMENT

Figure 6:
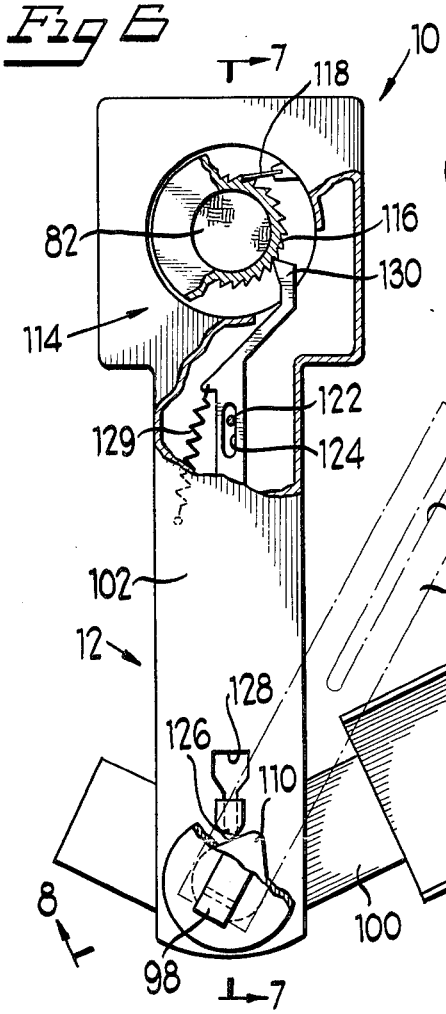
FIG. 6 is a partially fragmented top plan view of an alternate embodiment of a stamp design kit embodying the concepts of the present invention.
Figure 9:
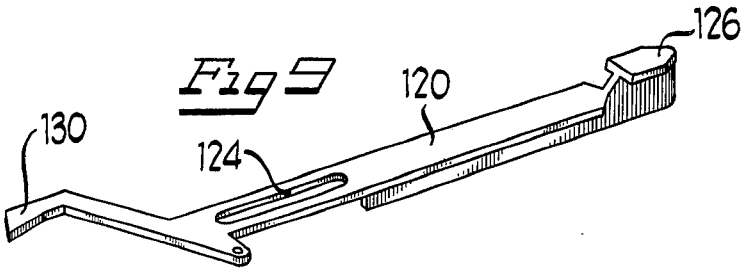
FIG. 9 is a perspective view of the ratchet-pawl mechanism of the alternate embodiment of the stamp design kit.
Figure 10:
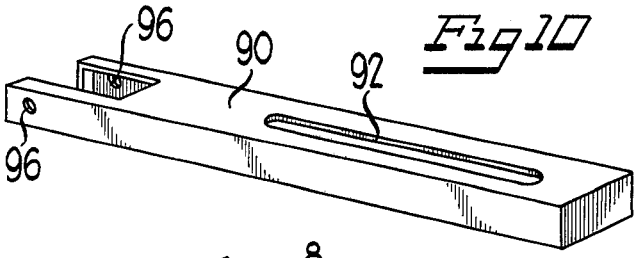
FIG. 10 is a perspective view of a stamp support arm for use on the alternate embodiment.
Figure 7:
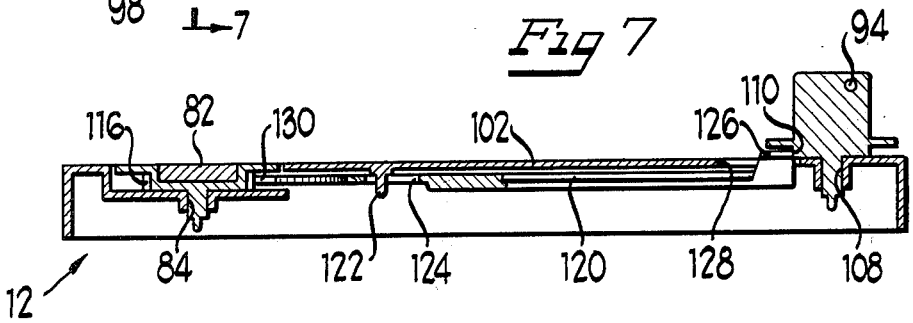
FIG. 7 is a vertical section of the stamp design kit, taken generally along line 7—7 of FIG. 6.
Figure 8:
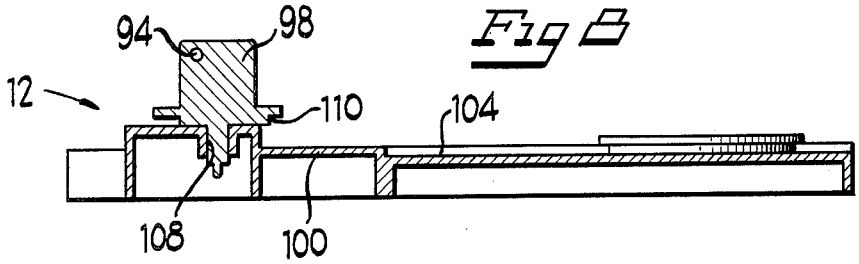
FIG. 8 is another vertical section taken generally along line 8—8 of FIG. 6.

The stamp design kit of the present invention, generally designated 10 (FIGS. 1 and 2), includes a base, generally designated 12, including a first horizontal leg 14 and a second horizontal leg 16 which diverge generally as shown in FIGS. 1 and 2. The first leg 14 includes an oblong recess 18 for supporting an ink pad 20. The ink pad 20 is provided with a carrier 22 and includes a circular flange 24 around the top thereof so that the ink pad 20 can be moved along the length of the recess 18 longitudinally of leg 14.

A stamp support arm 28 is universally mounted generally at the juncture of the two legs 14 and 16 by a universal or gimbal mounting. The stamp support arm is pivoted about a horizontal axis by a journal pin 30 mounted within a rotatably mounted yoke 32. The yoke 32 permits horizontal pivotal movement of the stamping arm 28 by its rotary mounting within an aperture 34 provided in the base 12, for rotation of the yoke about a vertical axis.

A stamp 38 (FIG. 5) is mounted by a base 40 to a sliding flange 42. The stamp 38 and base 40 are connected by an adjustable mounting means, generally designated 44 (FIG. 4), to the stamp support arm 28. The adjustable mounting means 44 includes a pair of L-shaped flanges 46 mounted to the underside of an indicating disc 48 for receiving engagement with the flange 42 of the stamp. The indicator disc 48 is connected by a shaft 50 to a control knob 52 at the top arm 28. The shaft 50 is inserted within a generally longitudinal slot 56 in the arm 28 so that the adjustable mounting means and therefore the stamp 38 can be moved at any position longitudinally within the slot 56. A generally U-shaped indicator 58 also is mounted by the shaft 50 to the stamp support arm 28. A plurality of hatch marks 60 provided along the length of the slot 56 enable the indicator 58 to assist in realignment of the stamp 38 after it has been moved. Additionally, a pointer 62 on the indicator 58 is provided in alignment with a plurality of additional marks 64 provided on the top of the indicating disc 48. The marks 64 enable the user to correctly and accurately determine the relative angular movement of the stamp with respect to the stamp support arm 28. Therefore, the stamp may be moved anywhere along the slot 56 and at any relative angular position with respect to the arm 28.

A generally raised oval stamping surface 70 is provided along the outer end of the second leg 16 for supporting a transfer sheet of paper 72, or the like, in FIG. 1, for engagement with the stamp surface 70 when the arm is in the position as shown in FIGS. 2 and 3. As the stamp support arm 28 is manually moved between the ink pad 20 and the stamping surface 70 a series of images 75 can be reproduced on the sheet of paper. Particularly, it is possible to make a circular arrangement of images by use of a pivotal connecting means, generally designated 80, at the extreme end of the second leg 16. More particularly, the pivotal connecting means includes a resilient pad 82 rotatably mounted by an aperture 84 in the arm 14 to support the transfer sheet 72 for relative movement. The transfer sheet is connected to the pad 82 by a suitable adhesive on top of the pad 82 for rotary movement therewith.

Referring to FIG. 1, it can be seen that a circular pattern of successive stamp images can be made by repetitive inking and stamping of the transfer sheet 72 after it is rotated slightly between imprintings. Additionally, since the stamp 38 is longitudinally and rotatably mounted by the arm 28, various other types of patterns can be made.

An alternate embodiment of the stamp design kit 10 is shown in FIGS. 6 through 10 and like numbers will be used to identify similar components. The stamp design kit 10 in FIG. 7 includes means for automatically rotating the transfer sheet 72 so that a circular pattern 75 (FIG. 1) is made automatically. This embodiment includes a generally rectangular stamp support arm 90 which includes a suitable slot 92 for mounting a stamp 38 by an adjustable mounting means 44, as described above. The stamp support arm 90 is pivotally connected by a pair of pins 94 (FIGS. 7 and 8) through apertures 96 on a generally vertical axle 98. The axle 98 is rotatably mounted on the base 12. The base 12 includes a first horizontal leg 100 and a second horizontal leg 102 which diverges, generally as shown in FIG. 6. The first leg 100 inclues a channel member 104 which supports the ink pad 20 for movement along the length of the channel member 104, as previously described.

The stamp support arm is universally mounted by the axle 98 which is rotatably mounted in a journal 108 at the juncture of the two legs 100 and 102 of the base. A single lobed cam 110 is provided on the axle for engagement with a pawl and ratchet means, generally designated 114, for automatic rotation of the transfer sheet 72. More particularly, the pawl and ratchet means 114 includes the rotatable resilient pad 82 which is connected to a ratchet gear 116. A small leaf spring 118, secured to the underside of the leg in engagement with the ratchet 116, limits rotation of the ratchet gear and thus the resilient pad 82 to one direction. A pawl 120 (FIG. 9) is reciprocally mounted on the underside of the leg 102 by a pin or rivet 122. The pin 122 extends through a slot 124 in the pawl 120. The pawl 120 also includes a generally pointed cam follower 126 which extends through a slot 128 in the top of the leg 102 in engagement with the single lobed cam 110. The wide cam follower 126 provides additional support for the pawl 120. The pawl 120 is biased by a spring 128 in a direction to maintain engagement between the cam 110 and the cam follower 126. A pawl finger 130 on the opposite end of the pawl 120 engages the ratchet gear 116 and drive the resilient pad 82 in a counterclockwise direction each time the cam 110 engages the cam follower 126.

As with the previous description, a stamp 38 on the stamp support arm 90 is repeatedly moved between the stamp pad 20 and the transfer sheet 72 to make successive images. In this alternate embodiment, each time the stamp support arm 90 is moved from the pad 20 to the transfer sheet 72, the single lobed cam 110 engages the cam follower 126 to actuate the pawl and ratchet means 114 thereby causing the transfer sheet 72 to incrementally rotate. This design therefore provides for automatic rotation of the transfer sheet 72 to facilitate the construction of generally uniform circular designs.

The foregoing detailed description has been given for clearness of understanding only and no unnecessary limitations should be understood therefrom as some modifications will be obvious to those skilled in the art.

We claim:

1. A stamping kit, comprising:

a frame having two horizontal, generally elongated, diverging leg portions;

a selectively movable support arm mounted on the frame for movement between a first position above one of said leg portions and a second position, above the other of said leg portions;

an ink pad mounted on one of said leg portions and a stamping surface provided on the other of said leg portions; and a stamp secured to said arm for selective movement therewith to contact said ink pad when the arm is in its first position to supply ink to the stamping surface and subsequent transferring of said ink to a suitable transfer sheet placed on the stamping surface by movement of said arm to said second position, wherein said second leg portion includes means for pivotally connecting the transfer sheet thereto to maintain proper rotational alignment between the successive ink transfers.

2. The stamping kit of claim 1 wherein said pivotal means comprises a generally rotatable pad provided on the end of said second leg portion and a suitable adhesive thereon to secure said transfer sheet to said rotatable pad.

3. A stamping kit, comprising:

a frame having two horizontal, generally elongated, diverging leg portions;

a selectively movable support arm mounted on the frame for movement between a first position above one of said leg portions and a second position, above the other of said leg portions;

an ink pad mounted on one of said leg portions and a stamping surface provided on the other of said leg portions; and a stamp secured to said arm for selective movement therewith to contact said ink pad when the arm is in its first position to supply ink to the stamping surface and subsequent transferring of said ink to a suitable transfer sheet placed on the stamping surface by movement of said arm to said second position, wherein said arm is pivotally mounted to said frame by a gimbal mounting for pivotal movement with respect to said frame in both a horizontal and vertical plane.

4. A stamping kit, comprising:

a frame having two horizontal, generally elongated, diverging leg portions;

a selectively movable support arm mounted on the frame for movement at least between a first position above one of said leg portions and a second position, above the other of said leg portions;

an ink pad mounted on a first of said leg portions and a stamping surface provided on a second of said leg portions;

a stamp; and adjustable mounting means to secure said stamp to the support arm for longitudinal movement with respect thereto, said adjustable mounting means comprising a longitudinal slot provided in said support arm and a stamp carrier mounted within said slot for longitudinal movement relative to the arm, said stamp being mounted by said stamp carrier to contact the ink pad when the arm is in its first position to supply ink to the stamping surface thereof, and subsequently transferring of said ink to a suitable transfer sheet placed on the stamping surface by selective movement of said arm to the second position, wherein said stamp carrier includes means for rotatably mounting said stamp to said arm for varying degrees of rotation about a central vertical axis of the stamp to vary the angular orientation of the stamp.

5. The stamping kit of claim 4 including indicating means on the carrier to indicate the relative angular orientation of said stamp with respect to said arm.

6. A stamping device, comprising:

a frame portion;

an ink pad;

a selectively movable support arm mounted on the frame by means permitting universal movement relative to said frame in a horizontal and vertical plane relative to said frame portion between at least a first position and a second position;

an ink pad mounted on said frame in vertical alignment with said support arm when in said first position and a stamping surface provided on the frame in vertical alignment with said support arm when in its second position;

a stamp for mounting on the support arm; and a stamp carrier mounted on said support arm for mounting said stamp, said stamp being mounted by said stamp carrier to contact the ink pad when the support arm is in its first position to supply ink to the stamping surface thereof, and subsequently transferring of said ink to a suitable transfer sheet placed on the stamping surface by selective movement of said arm to the second position.

7. The stamping kit of claim 6 wherein said frame includes guide means for said support arm to assure proper alignment of said stamp with said ink pad and said stamping surface on the frame.

8. The stamping kit of claim 6 wherein said ink pad is slidably mounted on said frame leg to permit adjustment thereof for proper alignment with said stamp.

9. A stamping kit, comprising:

a frame having two horizontal, generally elongated diverging leg portions;

a selectively movable support arm mounted on the frame for movement at least between a first position above one of the leg portions and a second position above the other of said leg portions, said support arm being pivotally mounted to said frame by a gimbal mounting for pivotal movement in both a horizontal and vertical plane with respect to said frame;

an ink pad mounted on one of said leg portions and a stamping surface mounted on the other of said leg portions;

a stamp for mounting on the support arm;

a stamp carrier mounted on said support arm for mounting said stamp for movement to contact the ink pad when the arm is in its first position to supply ink to the stamping surface thereof and to transfer ink to a suitable transfer sheet placed on the stamping surface by selective movement of said arm to the second position; and guide means for said support arm to assure proper alignment of said stamp with said ink pad and said stamping surface, said guide means including detent means formed on the frame and a guide surface provided on said arm for engagement therewith to insure proper alignment.

10. A stamping kit, comprising:

A frame having two generally elongated, horizontal, diverging leg portions;

an ink pad longitudinally slidably mounted on a first of said leg portions and a stamping surface provided on the second of said leg portions;

selectively movable stamp support arm universally mounted on the frame for movement about generally horizontal and vertical axes with respect to the frame from a first position generally above said first leg and a second position, generally above said second leg;

a stamp carrier mounted to said support arm by an adjustable mounting means for longitudinal as well as rotational movement with respect to said arm; and a stamp secured by said carrier to said support arm for selective movement therewith to contact the ink pad when the arm is in said first position to supply ink to the surface of said stamp and subsequent transferring of said ink to produce an image on a suitable transfer sheet placed on said stamping surface by movement of said arm to said second position.

11. The stamping kit of claim 10 wherein said stamp is removably mounted to said carrier.

12. A stamping kit, comprising:

a frame having two generally horizontal, elongated diverging leg portions;

a selectively movable support arm mounted on the frame for movement between a first position above one of said leg portions and a second positioned above the other of said leg portions;

an ink pad mounted on one of said leg portions and a stamping surface provided on the other of said leg portions;

alignment means for rotatably mounting a traansfer sheet on said stamping surface;

a stamp secured to said arm for selective movement therewith to contact said ink pad when the arm is in its first position to supply ink to the stamping surface and subsequent transferring of said ink to the transfer sheet on the stamping surface by movement of said arm to said second position; and means for automatically rotating the alignment means between each stamping operation.

13. The stamping kit of claim 12 wherein the means for rotating the alignment means comprise a pawl and ratchet means connected to said support arm for incrementally rotating the transfer sheet.

14. The stamping kit of claim 13 wherein said pawl and ratchet means includes cam means associated with said movable support arm for actuation thereof in response to movement of the support arm from its first position to its secnd position.

* * * * *